US010265748B2

(12) United States Patent
Haselboeck

(10) Patent No.: US 10,265,748 B2
(45) Date of Patent: Apr. 23, 2019

(54) PRODUCTION DEVICE WITH MEANS FOR TOOL POSITION SENSING AND METHOD FOR OPERATING SAID DEVICE

(75) Inventor: Alfred Haselboeck, Rohrbach (AT)

(73) Assignee: TRUMPF Maschinen GmbH & Co. KG., Pasching (AT)

( * ) Notice: Subject to any disclaimer, the term of this patent is extended or adjusted under 35 U.S.C. 154(b) by 673 days.

(21) Appl. No.: 13/982,836

(22) PCT Filed: Feb. 1, 2012

(86) PCT No.: PCT/AT2012/050014

§ 371 (c)(1),
(2), (4) Date: Aug. 27, 2013

(87) PCT Pub. No.: WO2012/103565

PCT Pub. Date: Aug. 9, 2012

(65) Prior Publication Data

US 2013/0327104 A1 Dec. 12, 2013

(30) Foreign Application Priority Data

Feb. 1, 2011 (AT) ..... A 129/2011

(51) Int. Cl.
*B21D 5/02* (2006.01)
*B21D 37/14* (2006.01)
(Continued)

(52) U.S. Cl.
CPC ..... *B21D 5/02* (2013.01); *B21D 5/0236* (2013.01); *B21D 5/0254* (2013.01); *B21D 11/22* (2013.01); *B21D 37/14* (2013.01); *B21D 37/04* (2013.01)

(58) Field of Classification Search
CPC .. B21D 5/0254; B21D 5/0236; B21D 5/0209; B21D 5/02; B21D 5/0218; B21D 5/0227;
(Continued)

(56) References Cited

U.S. PATENT DOCUMENTS 5,182,936 A * 2/1993 Sartorio ..... B21D 5/0281 72/420
5,211,045 A 5/1993 Shimizu
(Continued)

FOREIGN PATENT DOCUMENTS

AT 503 196 A1 8/2007
CH 668 035 A5 11/1988
(Continued)

OTHER PUBLICATIONS

International Search Report of PCT/AT2012/050014, dated Jun. 29, 2012.

*Primary Examiner* — Debra M Sullivan
(74) *Attorney, Agent, or Firm* — Collard & Roe, P.C.

(57) ABSTRACT

The invention relates to a production device (1) and to a method of operating said device, comprising a bending press (2) for producing workpieces shaped by bending between bending tools (13) of a stationary bench beam (8) and a press beam (9) that is adjustable in relation thereto. The production device (1) further comprises a tool magazine (4) and a handling device (3) with a gripping device (17) for the bending tools (13) and a stop device (23) which has at least one adjustable stop finger (28), and also a control and monitoring device (24). The stop device (23) is connected to a comparator circuit of the control and monitoring device (24) and has a measuring sensor system and at least one measuring means for determining reference position data of the bending tool (13).

20 Claims, 3 Drawing Sheets

(51) Int. Cl.
*B21D 11/22* (2006.01)
*B21D 37/04* (2006.01)

(58) Field of Classification Search
CPC ..... B21D 11/22; B21D 43/26; B21D 5/002; B21D 37/04; B21D 37/145; B21D 37/14; B23Q 3/183; B23Q 3/186; B23Q 3/15513
See application file for complete search history.

(56) References Cited

U.S. PATENT DOCUMENTS 6,644,080 B2 * 11/2003 Lindstrom ..... B21D 5/002 72/19.4
6,938,454 B2 9/2005 Strasser et al.
7,797,975 B2 * 9/2010 Halford ..... B21D 37/02 269/277
8,511,130 B2 * 8/2013 Prevey, III ..... B23K 26/0069 29/90.01
2003/0064871 A1 * 4/2003 Akami ..... B21D 5/02 483/1
2005/0268680 A1 * 12/2005 Bruggink ..... B21D 5/0209 72/15.1
2006/0042339 A1 3/2006 Denkmeier
2007/0101788 A1 * 5/2007 Massee ..... B21D 22/14 72/83
2008/0066510 A1 * 3/2008 Ikeda ..... B21D 5/02 72/18.2
2008/0226436 A1 9/2008 Denkmeier et al.
2010/0269555 A1 10/2010 Theis et al.
2011/0048088 A1 * 3/2011 Austaller ..... B21D 5/002 72/6.1

FOREIGN PATENT DOCUMENTS

DE 10 2010 016 646 A1 11/2010
EP 0 471 848 A1 2/1992
EP 1 136 146 A1 9/2001
EP 1 471 402 A2 10/2004
EP 1 600 257 A 11/2005
EP 1 600 257 A1 11/2005
EP 1 702 727 A2 9/2006
EP 1 916 072 A1 4/2008
EP 2 138 247 A2 12/2009
JP S57-199522 A 12/1982
JP H03-208585 A 9/1991
JP H03-111412 U 11/1991
JP H07-108324 A 4/1995
JP H09-052124 A 2/1997
JP H09-295064 A 11/1997
JP 2002-001437 A 1/2002
JP 2004-280529 A 10/2004
JP 2005-074446 A 3/2005
JP 2009-113082 A 5/2009
JP 2009-285713 A 12/2009

* cited by examiner

PRODUCTION DEVICE WITH MEANS FOR TOOL POSITION SENSING AND METHOD FOR OPERATING SAID DEVICE

CROSS REFERENCE TO RELATED APPLICATIONS

This application is the National Stage of PCT/AT2012/050014 filed on Feb. 1, 2012, which claims priority under 35 U.S.C. § 119 of Austrian Application No. A 129/2011 filed on Feb. 1, 2011, the disclosures of which are incorporated by reference. The international application under PCT article 21(2) was not published in English.

BACKGROUND OF THE INVENTION

1. Field of the Invention

The invention relates to a production device and a method of operating the production device.

2. The Prior Art

Document JP 09-052124 A discloses a bending device for reducing the time involved in inserting bending tools exactly in tool holders of press beams, by means of which the insertion operation takes place using an NC controller mode. A plurality of sensors for detecting tool dimensions in a scanner element of a rear stop arrangement displaceable in three spatial directions extending at a right angle to one another receives the requisite tool data via a barcode and the rear stop has a barcode reader. This enables an exact positioning of the bending tool in the tool holder of the press beam to be obtained.

Document EP 1 600 257 A1 discloses a position detecting system integrated in a bending tool holder, which is attached to a press beam of a bending press. The bending tool holder has capacitive detection sensors in the support surface for the bending tool extending across a length of the tool holder, by means of which the exact position of the tool is detected in the direction of longitudinal extension of the tool holder on the basis of the tool length derived from the extent of overlap when the bending tool is inserted in the tool holder in an overlapping position, thereby also enabling the position of the bending tool to be fixed in the tool holder in accordance with a predefined desired position.

Another document, EP 0 471 848 A1, discloses a rear stop arrangement on a bending press against which a tool part is placed in readiness for a bending operation between bending tools. The rear stop arrangement has stop fingers on an NC adjusting device displaceable in three spatial directions extending at a right angle to one another and is provided with a measuring and control system by means of which any final correction to the position of the stops which might be necessary to obtain programmed predefined positions can be made prior to running the forming operation as a function of contours of the bending tools determined by the measuring system.

SUMMARY OF THE INVENTION

The objective of the invention is to propose a production device and a method of operating such, by means of which the press beam of the bending press can be set up with exactly positioned equipment on an automated basis obviating the need for subsequent corrective measures.

This objective of the invention is achieved by the features described herein.

The advantage of the solution proposed by the invention is a rapid and automated process of setting up the bending machine of a production device with the bending tools needed for running a predefined forming operation with a high positioning accuracy of the bending tools in the corresponding tool holders of the press beam in accordance with program-based process parameters, thereby avoiding incorrect set-up and achieving a high productivity of the production device by minimizing non-productive time and obtaining a high process quality and reducing set-up and production times and hence process costs.

Also of advantage in this respect are embodiments which offer a plurality of high-quality, proven solutions for long-term use free of disruption, each of which can be specifically adapted to the respective application.

However, additional embodiments with a stop finger mounted an a finger carrier of a stop device so as to be pivotable about three degrees of freedom are also of advantage because they result in a very compact design of the stop device conforming to high quality requirements.

Finally, embodiments with codes on the tools are also of advantage because they enable fully automated management of the bending tools and their transfer, in addition to which exact data such as insertion times, forming operations, etc., is available, which might be essential to the maintenance of the bending tools, for example.

The objective of the invention is also achieved by a method of setting up a bending press with a bending tool as described herein. The advantage of this method is that although variances in position which occur during operation of a handling device for automated set-up operations of press beams due to the differing weights of the bending tools as well as other mechanically induced effects cannot be avoided, control parameters for controlling the path of the handling device are obtained by detecting an ACTUAL position of the bending tools in a reference position prior to the DESIRED position of the bending tools, thereby enabling the bending tools to be inserted in the tool holders with a high positioning accuracy in accordance with the predefined desired position data and enabling the subsequent production sequence to proceed without disruption.

There are other possible advantageous features in that the bending tool being moved to the reference position is detected on the basis of a contact with at least one of the stop fingers, and the stop finger is moved relative to the bending tool, whereby it is necessary to make only slight adjustments to the stop device to obtain an exact position detection of an ACTUAL position in a reference position and a production device that is already in operation can also be subsequently set up in readiness for running the measures proposed by the invention with little extra effort.

Also possible are the advantageous features that the bending tool being moved into the reference position is detected on the basis of a contact with at least one of the stop fingers, and the bending tool is moved by the handling device relative to the stop finger, whereby the cycle time for detecting variances based on contact in a reference position during preparation and for detecting the ACTUAL position data of the bending tool is reduced.

Also of advantage are the features wherein the differences in data determined in the comparator circuit between the ACTUAL position data and the desired position data are detected as control parameters for controlling the path of the handling device in addition to the bending tool data and tool position data stored in the data memory, because the control and monitoring device of the production device immediately compiles the control parameters necessary for positioning the bending tool in the predefined desired position.

Other advantageous features occur, whereby the ACTUAL position data adapted to the respective task is detected in up to three axial directions, namely an X axial direction, a Z axial direction, and an R axial direction.

Finally, however, the features wherein the allocation of a magazine place of the tool magazine for holding the bending tools in readiness for a set-up operation is organized on a chaotic basis based on the free availability of a magazine place via a magazine allocation module of the control and monitoring device, and the allocated magazine place is stored in the data memory of the control and monitoring device, are also of advantage because non-productive time during the transfer of the bending tools to set up the tool magazine as well as access times for removing the bending tools are minimized.

BRIEF DESCRIPTION OF THE DRAWINGS

To provide a clearer understanding, the invention will be described in more detail with reference to the appended drawings.

These are highly schematic, simplified diagrams illustrating the following.

DETAILED DESCRIPTION OF THE PREFERRED EMBODIMENTS

Figure 1:
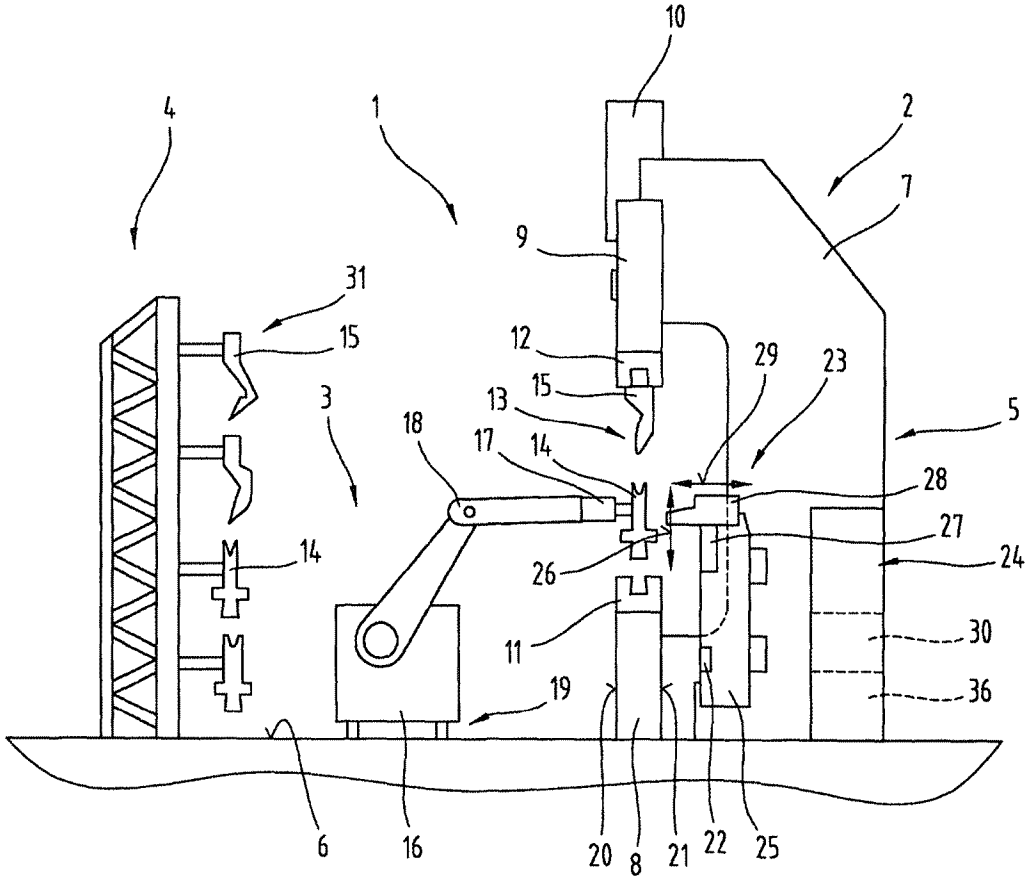
FIG. 1 is a simplified diagram illustrating a production device proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

Figure 2:
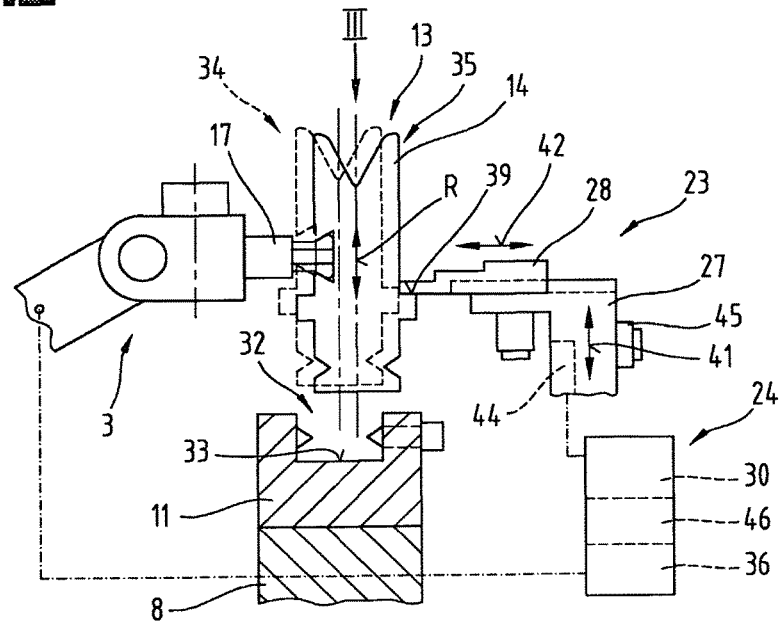
FIG. 2 shows a detail of the production device proposed by the invention, viewed in section along line II-II indicated in FIG. 3.
Figure 3:
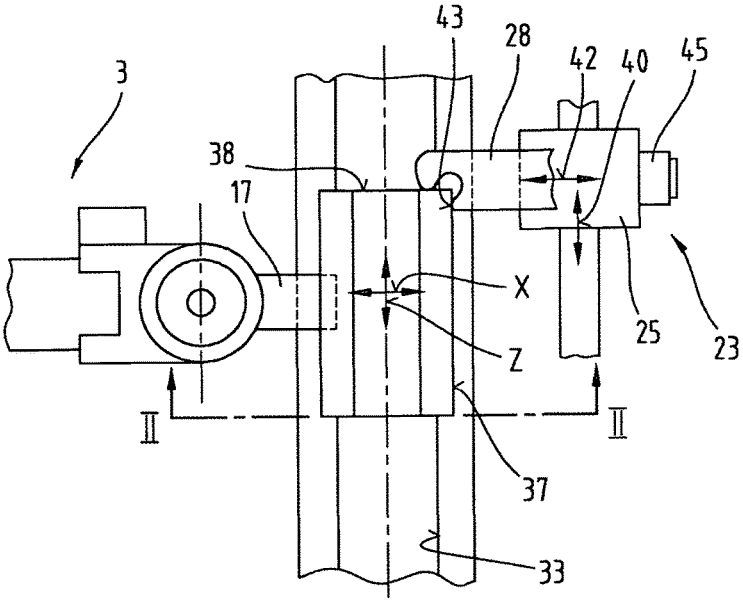
FIG. 3 shows the detail of the production device proposed by the invention indicated by arrow III in FIG. 2.

FIGS. 1 to 3 illustrate a production device 1 for producing workpieces shaped by bending, comprising a bending press 2, a handling device 3 and a tool magazine 4. A machine frame 5 of the bending press essentially comprises two mutually spaced apart side panels 7 connected by a cross-member, not illustrated, disposed parallel with one another and extending in vertical planes perpendicular to a standing surface 6, and a bench beam 8 connected to the latter. Disposed in guide arrangements of the side panels 7 is a press beam 9 which is displaceable relative to the bench beam 8 in the direction perpendicular to the standing surface 6 and connected in a driving relationship to drive means 10 disposed on the side panels 7 or machine frame 5, for example hydraulic cylinders, electric spindle drives, etc.

Disposed in oppositely lying tool holders 11, 12 provided with clamping devices is a region for equipping with bending tools 13, for example a bending die 14 in the tool holder 11 of the bench beam 8 and a bending stamp 15 in the tool holder 12 of the press beam 9, corresponding to default settings for the respective bending operation and workpiece to be formed.

Depending on the workpieces to be produced in a specific production run or maintenance to be carried out on the bending tools 13, it is necessary to re-equip and thus change the bending tools 13 at different time intervals.

For an automated workpiece and tool transfer, the production device 1 is provided with the handling device 3, for example a multi-axis robot 16 with a multi-functional gripping device 17, for example pince grippers, suction grippers, etc., on a terminal arm 18 of the multi-axis robot 16. The multi-axis robot 16 is disposed in a displaceable arrangement 19 displaceable in the direction running parallel with a front face 20 of the bench beam 8.

Disposed along a rear face 21 of the bench beam 8 and hence inside the machine frame 5 and between the side panels 7 is a stop device 23 along a linear guide arrangement 22, which preferably comprises two stop carriages 25 displaceable in the guide arrangement 22 in the direction of a Z axis independently of one another and activated via a control and monitoring device 24 of the bending press 2.

The stop carriage 25 provides a mount for a finger carrier 27 driven in a linear guide arrangement and displaceable in the direction extending perpendicular to the direction of displacement of the stop carriage 25—indicated by double arrow 26—in the direction of an R axis, with a stop finger 28 disposed on it, which is motor driven so as to be displaceable in a guide arrangement of the finger carrier 27 in the direction extending perpendicular to the direction of displacement of the finger carrier 27—indicated by double arrow 29—in the direction of an X axis.

The drives for the stop carriage 25 in the Z axial direction and the finger carrier 27 in the R axial direction and the stop finger 28 in the X-axial direction are activated centrally via program default settings and data stored in a data memory 30.

Also of advantage is the fact that the production device 1 has the tool magazine 4 in the gripping range of the handling device 3, with magazine places 31 for storing the bending tools 13, and it is of advantage to manage the tool magazine 4 with its magazine places 31 in the control and monitoring device 24 on the basis of a chaotic system of picking up and putting back the bending tools 13.

To this end, the magazine places 31 can be freely allocated, as and when available, to the bending tools 13, each of which has a unique, unambiguous code. The code of the bending tool 13 is obtained for an automated reading operation by means of a barcode or electronic data carrier applied to the bending tool 13. Due to the management system in the control and monitoring device 24 and the allocation of magazine places 31 to the respective bending tools 13, the handling device 3 is able to access the bending tool 13 in the tool magazine 4 specifically needed in accordance with the planned default settings for a forming process in order to set up the bending press 2 and take it out of the tool magazine 4 by means of the gripping device 17.

The other steps involved in running a set-up operation, e.g. inserting the bending die 14 in the tool holder 11 of the bench beam 8, may be seen in FIGS. 2 and 3 and the set-up operation will be described in detail below with reference to these drawings.

It should be pointed out that the operation described is also relevant for insertion of the bending stamp 15 in the tool holder 12 of the press beam 9, for which purpose the displaceable press beam is placed in a predefined position, preferably in the top end position, by the drive means.

The bending die 14 picked up by the gripping device 17, e.g. a pince gripper, is controlled by means of path control default values of the handling device 3 stored in the data memory 30 of the control and monitoring device 24, being moved on the basis of X and/or Z and/or R coordinates to a fictitious reference position 34 in the immediate vicinity of a required desired position 32 in a holding groove 33 of the tool holder 11, corresponding to the position indicated by broken lines, which guarantees that there will be no collision between the bending die 14 and the tool holder 11 due to variances in the ACTUAL position 35 which the bending die 14 has in fact assumed—indicated by solid lines. The reference position 34 is preferably a position of the bending tool 13 in which the bending tool 13 is still outside the holding groove 33, in other words disposed slightly above or below the tool holders 11, 12 in the R axial direction, but the X and Z axial direction are still predefined in accordance with the predefined DESIRED positions, which means that re-positioning distances resulting from the variances which have occurred are kept short.

These variances are caused by the ACTUAL position 35 assumed relative to the theoretically activated reference position 34 as a result of mechanical effects acting on the handling device 3, such as different weights of the bending tools 13 as well as the effects of temperature, tolerances in the guides and drives of the handling device 3 etc.

On the basis of the position data pertaining to the fictitious reference position 34 and the position data pertaining to the effective actual position 35 determined in the manner described in detail below as well as the requisite data for the desired position 32 stored in a path control module 36 of the control and monitoring device 24, a position adjustment is made to the tool position from the ACTUAL position 35 to the required desired position 32 via the path controller of the handling device 3, so that insertion in the tool holder 11 takes place in the requisite exactly desired position 32 and the bending die 14 is secured in the tool holder 11, the bending die 14 is released from the gripping device and the set-up operation thus terminated.

In one possible embodiment, the position data for the ACTUAL position 35 of the bending die 14 is detected on the basis of the X and/or Z and/or R co-ordinates by means of the stop device 23 in an operation whereby the stop finger 28 is placed in contact with reference surfaces of the bending tool 13, e.g. three tool surfaces 37, 38, 39 oriented respectively at right angles to one another, by displacing the stop carriage 25 in the Z axial direction—indicated by double arrow 40—displacing the finger carrier 27 in the R axial direction—indicated by double arrow 41—and displacing the stop finger 28 in the X axial direction—indicated by double arrow 42.

The ACTUAL position data of the bending tool determined by means of a measuring sensor system 44 of the stop device 23 incorporating a measuring means 43, e.g. proximity sensors of the stop finger 28 or, for example, motor current measuring sensors of drive means 45 for displacing the stop finger 28, finger carrier 27 and stop carriage 25, is compared with the DESIRED position data stored in a comparator circuit 46 of the control and monitoring device 24 stored in the data memory 30, and control parameters in the path control module 36 for controlling the path of the handling device 3 are derived on the basis of the variances, after which the bending tool 13 is positioned in the predefined DESIRED position 32 in the tool holder 11.

Finally, it should be pointed out that the method does not necessarily require the bending tool 13 to be positioned in the three axial directions R, X and Z described and instead, it would naturally also be possible to position the bending tool 13 in only one or two or three axial directions, as described.

It should also be pointed out that once the bending tool 13 has been inserted in the holding groove 33, another position sensing operation for variances may be run, in particular in the Z axial direction, after the bending tool has been clamped in the holding groove by means of the stop device 23 or measuring sensor system 44, and the sensed position data is compared with the predefined DESIRED position data. If it is ascertained that there are variances, these may be used as correction values applied to the control and monitoring device 24 or stored as such in the data memory as amended DESIRED position data and taken into account for the set-up operation of the other bending tool 13 or for controlling the path of the handling device 3 when making the workpiece ready for a forming operation.

Figure 4:
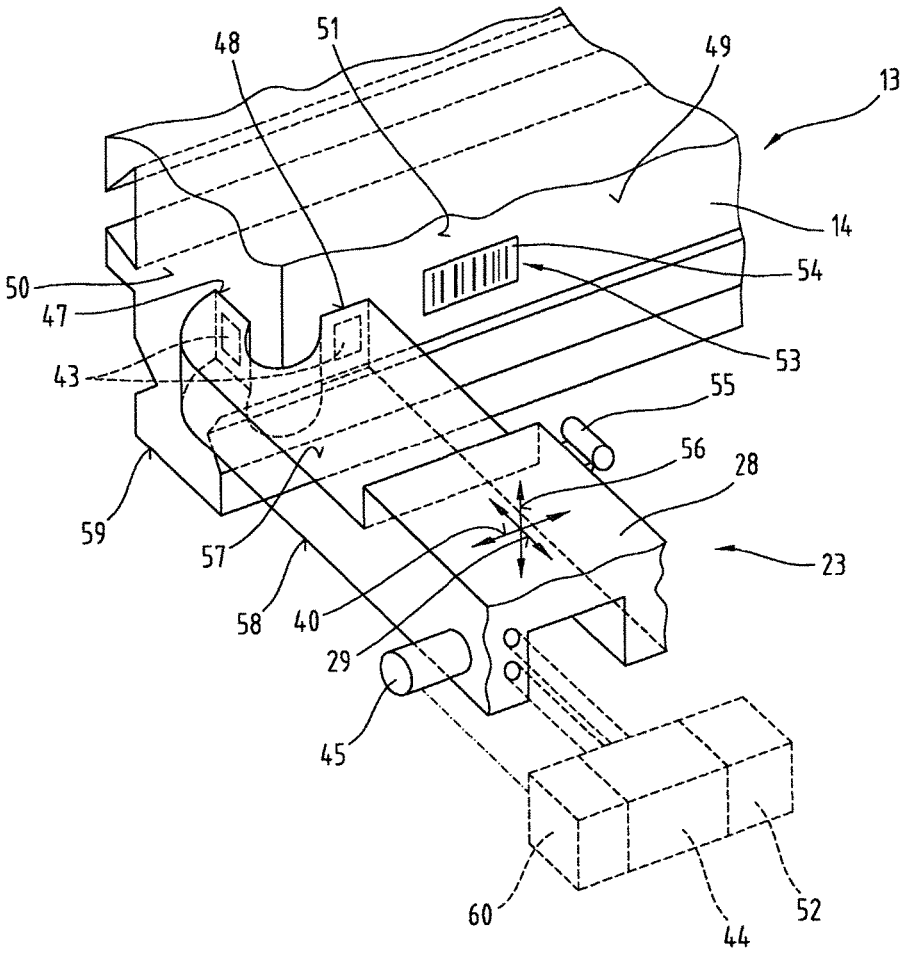
FIG. 4 is a detail illustrating how an ACTUAL position of a bending tool is detected in a reference position.

FIG. 4 illustrates one possible embodiment of the stop device 23 with the stop finger 28 for detecting the reference position data of the bending tool 13. From the bending tool 13 held by the handling device, not illustrated, in the ACTUAL position 35 for a set-up operation, with variances from an activated reference position induced by the device, the X and Z position data is determined in this embodiment by means of the measuring sensor system 44 and the measuring means 43 integrated in the stop finger 28 in contact surfaces 47, 48 extending at a right angle to one another by contacting movements of the stop finger 28 on tool reference surfaces 49 oriented at a right angle to one another, e.g. an end face 50 and a side face 51—indicated by double arrows 29, 40.

In this embodiment, the measuring means 44 are, for example, force measuring sensors, e.g. piezo-elements, integrated in the stop finger 28, proximity sensors, etc., the signals of which are transmitted to the measuring sensor system 44. By means of an NC control and measuring system 52 of the stop device 23, the X and Z position data of the ACTUAL position effectively assumed by the bending tool 13 is evaluated and on this basis, the position is corrected to the desired position of the bending tool 13 required for the insertion operation in the tool holder, not illustrated.

With this embodiment, as may also be seen from FIG. 4, a code 53, e.g. a barcode 54, is applied to the bending tool and the stop finger has a camera 55, for example, for monitoring the tool, thereby ensuring that an incorrect set-up operation with a bending tool 13 that is not suitable for the particular forming operation is prevented. The camera 55 may be a CCD camera.

Such communication means may also be used for managing the tool magazine and the removal of tools and storage of the tools in the tool magazine by means of the handling device.

As may also be seen from FIG. 4, it is possible, for example, to detect the ACTUAL position of the bending tool 13 in the R axial direction—indicated by double arrow 56. To this end, another measuring means 43 is provided on a top face 57 and/or bottom face 58 of the stop finger 28, for example. In another measuring operation, the position of the bending tool 13 is then determined by a contacting operation of the stop finger 28 in a plane extending perpendicular to the planes of the end face 50 and side face 51, e.g. on a bottom face 59 of the bending tool 13.

Another option for determining the position of the bending tool 13 in one, two or three spatial directions by a contacting operation of the stop finger 28 on the reference surfaces of the bending tool 13 is to measure the motor current uptake at every drive means 45 of the stop device 23 used to displace the stop finger 28 in the corresponding spatial directions. To this end, a current measuring sensor 60 is assigned to the drive means 45, which transmits a position signal to the measuring sensor system 44 or NC control and measuring system 52 when there is an increase in current due to a contacting operation of the stop finger 28 on the bending tool 13, and the respective co-ordinates constituting the ACTUAL position can be derived from this. The measuring sensor system 44 of the stop device 23 may also include at least one power measuring sensor assigned to the drive means 45 of the stop device 23 as measuring means 43. The measuring sensor system 44 of the stop device 23 may also include at least one laser beam measuring device disposed on a finger carrier 27 or stop finger 28 of the stop device 23 constituting the measuring means 43.

In the description given above, the ACTUAL position data of the bending tool 13 is determined on the basis of moving the stop device 23 or stop finger 28 relative to the bending tool 13 held in the ACTUAL position by the gripping device.

However, it should also be pointed out that in order to obtain the exact DESIRED position for inserting the bending tool 13 in the tool holder, it would also be possible to position at least one stop finger 28 of the stop device 23 in a position corresponding to a reference position of the bending tool 13 and move the bending tool 13 by means of the handling device 3 into contact with the stop finger 28 in the X axial direction and/or Z axial direction and/or R axial direction and thus set up ACTUAL position data as output data from which variances induced by the device have been removed in readiness for transferring the bending tool 13 to the predefined DESIRED position in the tool holder by means of the handling device.

The embodiments illustrated as examples represent possible variants of the production device for running the method proposed by the invention, and it should be pointed out at this stage that the invention is not specifically limited to the variants specifically illustrated, and instead various combinations are also fall within the scope of the invention, provided they are covered by the claims.

For the sake of good order, finally, it should be pointed out that, in order to provide a clearer understanding of the structure of the production device for running the method proposed by the invention, it and its constituent parts are illustrated to a certain extent out of scale and/or on an enlarged scale and/or on a reduced scale.

| List of reference numbers | |
|---|---|
| 1 | Production device |
| 2 | Bending press |
| 3 | Handling device |

-continued

| List of reference numbers | |
|---|---|
| 4 | Tool magazine |
| 5 | Machine frame |
| 6 | Standing surface |
| 7 | Side panels |
| 8 | Bench beam |
| 9 | Press beam |
| 10 | Drive means |
| 11 | Tool holder |
| 12 | Tool holder |
| 13 | Bending tool |
| 14 | Bending die |
| 15 | Bending stamp |
| 16 | Multi-axis robot |
| 17 | Gripping device |
| 18 | Terminal arm |
| 19 | Displaceable arrangement |
| 20 | Front face |
| 21 | Rear face |
| 22 | Guide arrangement |
| 23 | Stop device |
| 24 | Control and monitoring device |
| 25 | Stop carriage |
| 26 | Double arrow |
| 27 | Finger carrier |
| 28 | Stop finger |
| 29 | Double arrow |
| 30 | Data memory |
| 31 | Magazine place |
| 32 | DESIRED position |
| 33 | Holding groove |
| 34 | Reference position |
| 35 | ACTUAL position |
| 36 | Path control module |
| 37 | Tool surface |
| 38 | Tool surface |
| 39 | Tool surface |
| 40 | Double arrow |
| 41 | Double arrow |
| 42 | Double arrow |
| 43 | Measuring means |
| 44 | Measuring sensor system |
| 45 | Drive means |
| 46 | Comparator circuit |
| 47 | Contact surface |
| 48 | Contact surface |
| 49 | Tool reference surface |
| 50 | End face |
| 51 | Side face |
| 52 | Control and measuring system |
| 53 | Code |
| 54 | Barcode |
| 55 | Camera |
| 56 | Double arrow |
| 57 | Top face |
| 58 | Bottom face |
| 59 | Bottom face |
| 60 | Current measuring sensor |

The invention claimed is:

1. A production device comprising:

a bending press for producing a workpiece, the bending press comprising a stationary bench beam and a press beam displaceable relative to the stationary bench beam, the stationary bench beam having a first bending tool and the press beam having a second bending tool, the bending press being configured to shape the workpiece by bending the workpiece between the first bending tool of the stationary bench beam and the second bending tool of the press beam;

a tool magazine;

a handling device comprising a robot and a gripper for the first and the second bending tools, wherein the tool magazine is in a gripping range of the handling device;

a stop device on a rear face of the bench beam, the stop device having at least one displaceable stop finger; and a control and monitoring device comprising a path control module and comprising a comparator circuit;

wherein the first bending tool is one of the group consisting of a bending die and a bending stamp, and the second bending tool is the other one of the group consisting of the bending die and the bending stamp;

wherein the stop device has a measuring sensor system and at least one sensor;

wherein the measuring sensor system is connected to the comparator circuit of the control and monitoring device;

wherein the at least one sensor is configured to determine a variance of a measured actual position of the first or the second bending tool relative to a reference position, the at least one sensor being configured to determine the variance when the first or the second bending tool is held by the gripper;

wherein for determining the variance, the at least one sensor is configured to measure the position of a back tool surface of the first or the second bending tool and also the position of a side tool surface of the first or the second bending tool, the side tool surface being located in a right angle to the back tool surface of the first or the second bending tool;

wherein control parameters in the path control module are derived on the basis of the measured variance determined via the at least one sensor; and wherein the path of the handling device is controlled by the control parameters of the path control module.

2. The production device according to claim 1, wherein the at least one sensor comprises at least one force measuring sensor integrated in the stop finger.

3. The production device according to claim 2, wherein the force measuring sensor is provided in the form of a piezo-element integrated in at least one contact surface of the stop finger.

4. The production device according to claim 1, wherein the at least one sensor comprises at least one proximity sensor integrated in the stop finger.

5. The production device according to claim 1, wherein the stop device comprises a drive, and wherein the at least one sensor comprises at least one current measuring sensor configured to measure a current of the drive.

6. The production device according to claim 1, wherein the at least one sensor comprises at least one laser beam measuring device disposed on a finger carrier of the stop device or on the stop finger of the stop device.

7. The production device according to claim 1, wherein the measuring sensor system of the stop device comprises at least one camera on a finger carrier of the stop device or on the stop finger of the stop device.

8. The production device according to claim 7, wherein the camera is a CCD camera.

9. The production device according to claim 1, wherein the stop finger is mounted on a finger carrier of the stop device so as to be pivotable about three degrees of freedom.

10. The production device according to claim 9, wherein the at least one sensor comprises a first sensor, a second sensor, and a third sensor;

wherein the first sensor is configured to measure a first degree of freedom of the three degrees of freedom of the stop finger;

wherein the second sensor is configured to measure a second degree of freedom of the three degrees of freedom of the stop finger; and wherein the third sensor is configured to measure a third degree of freedom of the three degrees of freedom of the stop finger.

11. The production device according to claim 9, wherein the first or the second bending tool is provided with a code.

12. The production device according to claim 11, wherein the first or the second bending tool is provided with a microchip incorporating the code.

13. Method of setting up a bending press with a first bending tool for producing a workpiece shaped by bending, with a tool magazine and with a handling device comprising a robot and a gripper for transferring the first bending tool between the tool magazine and a stationary bench beam and/or a press beam of the bending press displaceable relative thereto, wherein the tool magazine is in a gripping range of the handling device, and with a stop device on a rear face of the stationary bench beam, the stop device comprising at least one multi-axial stop finger displaceable in a guide arrangement extending parallel with the stationary bench beam, and with a control and monitoring device, the method comprising steps of:

on the basis of bending tool data stored in a data memory of the control and monitoring device, picking up via the gripper the first bending tool corresponding to the bending tool data, the first bending tool being picked up from the bending tool magazine;

after the picking up, on the basis of tool position data stored in the data memory, moving the first bending tool via the gripper towards a reference position and into an actual position;

detecting actual position data of the actual position of the first bending tool via at least one sensor of a measuring sensor system of the displaceable stop finger of the stop device, the measuring sensor system being connected to a comparator circuit of the control and monitoring device, the sensor measuring a position of a back tool surface of the first bending tool and also a position of a side tool surface of the first bending tool, the side tool surface being located in a right angle to the back tool surface of the first bending tool;

comparing in the comparator circuit of the control and monitoring device the actual position data with desired position data for a desired position;

after the comparing, generating control signals for a drive of the handling device, the generating occurring in a path control module of the control and monitoring device on the basis of differences in the data between the actual position data and the desired position data, moving the first bending tool from the actual position into the desired position in a tool holder of one of the stationary bench beam and the press beam; and securing the first bending tool in the desired position, the bending press being configured to shape the workpiece by bending the workpiece between the first bending tool and a second bending tool, the second bending tool being secured in the other one of the stationary bench beam and the press beam;

wherein the first bending tool is one of the group consisting of a bending die and a bending stamp, and the second bending tool is the other one of the group consisting of the bending die and the bending stamp.

14. Method according to claim 13, wherein, in order to detect the actual position data, the first bending tool moved to the reference position is detected on the basis of a contact with the stop finger, and the stop finger is moved relative to the first bending tool.

15. Method according to claim 13, wherein, in order to detect the actual position data, the first bending tool moved to the reference position is detected on the basis of a contact with the stop finger, and the first bending tool is moved by the handling device relative to the stop finger.

16. Method according to claim 13, wherein the differences in data determined in the comparator circuit between the actual position data and the desired position data are detected as control parameters for controlling the path of the handling device in addition to the bending tool data and tool position data stored in the data memory.

17. Method according to claim 13, wherein the actual position data of the actual position of the first bending tool determined in the reference position is determined in an X axial direction of the bending press.

18. Method according to claim 13, wherein the actual position data of the actual position of the first bending tool determined in the reference position is determined in a Z axial direction of the bending press.

19. Method according to claim 13, wherein the actual position data of the actual position of the first bending tool determined in the reference position is determined in an R axial direction of the bending press.

20. Method according to claim 13, wherein the allocation of a magazine place of the tool magazine for holding bending tools in readiness for a set-up operation is organized on a chaotic basis based on the free availability of the magazine place via a magazine allocation module of the control and monitoring device, and the allocated magazine place is stored in the data memory of the control and monitoring device.

* * * * *